US005730115A

United States Patent [19]

Henderson

[11] Patent Number: 5,730,115

[45] Date of Patent: Mar. 24, 1998

[54] DEVICE FOR PREVENTING FLAREUP IN LIQUID FUEL BURNERS BY REGULATING FUEL FLOW INTO THE FUEL CHAMBER

[76] Inventor: Richard W. Henderson, P.O. Box 12681, Florence, S.C. 29504

[21] Appl. No.: 684,131

[22] Filed: Jul. 19, 1996

[51] Int. Cl.[6] ..... F24C 5/04

[52] U.S. Cl. ..... 126/96; 431/65

[58] Field of Search ..... 431/64, 65; 126/96

[56] References Cited

U.S. PATENT DOCUMENTS

| | | | |
|---|---|---|---|
| 1,392,187 | 9/1921 | Mahan | 137/405 |
| 1,623,161 | 4/1927 | Buerger | 137/405 |
| 1,706,704 | 3/1929 | Phillips | 137/405 |
| 1,725,538 | 8/1929 | Remnsnider | 137/405 |
| 2,056,702 | 10/1936 | Abadjieff | 431/64 |
| 2,165,162 | 7/1939 | Thornton | 431/117 |
| 2,253,056 | 8/1941 | Ullstrand | 431/64 |
| 2,484,184 | 10/1949 | Resek | 431/64 |
| 2,530,237 | 11/1950 | Finley | 431/64 |
| 3,169,519 | 2/1965 | Aizawa . | |
| 3,501,252 | 3/1970 | Richardson . | |
| 4,363,620 | 12/1982 | Nakamura . | |
| 4,664,095 | 5/1987 | Takahashi . | |
| 4,797,088 | 1/1989 | Nakamura . | |
| 4,872,831 | 10/1989 | Fujimoto . | |
| 5,080,578 | 1/1992 | Josephs . | |
| 5,165,883 | 11/1992 | Van Bemmel . | |
| 5,338,185 | 8/1994 | Henderson et al. | 431/34 |
| 5,409,370 | 4/1995 | Henderson | 431/2 |
| 5,456,595 | 10/1995 | Henderson . | |

FOREIGN PATENT DOCUMENTS 1205018 9/1970 United Kingdom .

OTHER PUBLICATIONS

Richard W. Henderson and George R. Lightsey, "Kerosene Heater Fires: Barometric Type", *Fire Marshals Bulletin* (87–5), pp. 8–10, Nov. 1987.

Richard W. Henderson and George R. Lightsey, "Kerosene Heater Fires: Barometric Type", *The National Fire and Arson Report*, vol. 6(1), pp. 2–4 (1988).

Richard W. Henderson and George R. Lightsey, "An Anti–Flareup Device for Barometric Kerosene Heaters", *Fire and Arson Investigator*, vol. 45 (2), 8 (1994).

Richard W. Henderson, "Barometric Kerosene Heaters", *Fire and Arson Investigator* vol. 39 (3), pp. 26–27 (1989).

John J. Lentini, "Gasoline and Kerosene Don't Mix–At Least, Not in Kerosene Heaters", *Fire Journal*, vol. 83 (4), pp. 13, 86 (1989) (Jul.–Aug.).

*Primary Examiner*—Carroll B. Dority
*Attorney, Agent, or Firm*—David Pressman

[57] ABSTRACT

A safety device for preventing uncontrolled burning in wick-fed liquid fuel burners of the type where a removable tank (10) feeds a sump (56), which in turn feeds a fuel chamber (24), which supplies the fuel to a wick burner. The chamber contains a float (54) that, in response to the presence of excess fuel in the chamber, rises and moves a member which obturates an opening (46) from the sump to the chamber, thereby causing the opening into the fuel chamber to be closed.

7 Claims, 2 Drawing Sheets

DEVICE FOR PREVENTING FLAREUP IN LIQUID FUEL BURNERS BY REGULATING FUEL FLOW INTO THE FUEL CHAMBER

BACKGROUND—CROSS-REFERENCE TO RELATED APPLICATIONS

This invention is an improvement over the inventions of several earlier applications, to-wit: Ser. No. 08/130,290, filed 1993 Oct. 4, now U.S. Pat. No. 5,338,185, granted 1994 Aug. 16, in the names of Richard W. Henderson and George R. Lightsey; Ser. No. 08/247,925, filed 1994 May 23, now U.S. Pat. No. 5,456,595, granted 1995 Oct. 10, in the name of Richard W. Henderson, Ser. No. 08/297,048, filed 1994 Sep. 30, now U.S. Pat. No. 5,409,370, granted 1995 Apr. 25, in the name of Richard W. Henderson, Ser. No. 08/365,804, filed 1994 Dec. 29, in the name of Richard W. Henderson and now U.S. Pat. No. 5,549,470, Ser. No. 08/514,583, filed 1995 Aug. 14, in the name of Richard W. Henderson; and Ser. No. 08/559,992, filed 1995 Nov. 17, now U.S. Pat. No. 5,551,865, granted 1996 Sep. 3, in the names of Richard W. Henderson and Samuel R. Henderson.

BACKGROUND—FIELD OF INVENTION

This invention relates to safety devices, specifically to a mechanism for prevention of flareup in barometric-type wick-fed liquid fuel burners.

BACKGROUND—DISCUSSION OF PRIOR ART

In wick-fed liquid fuel burners, such as kerosene heaters, liquid fuel from a fuel chamber is supplied to a wick which is exposed to the oxygen of the atmosphere. Once the wick has been ignited, flame intensity and heat generation are controlled by positioning the wick within a wick-receiving combustion chamber.

A common type of kerosene heater is the barometric style, in which gravity causes liquid fuel to be delivered to a horizontal fuel chamber from a vertically-oriented, removable tank inserted into the fuel chamber. The flow of fuel from the removable tank into the fuel chamber is governed by a barometric valve in the cap on the removable tank, which, in normal operation, maintains the level of the fuel in the fuel chamber at the level of the barometric valve. A partial vacuum above the fuel in the removable tank prevents the fuel from flowing into the fuel chamber until the fuel level in the fuel chamber drops below the barometric valve, which allows air to enter the removable tank. As air enters the removable tank through the barometric valve, Fuel in the removable tank flows into the fuel chamber until its level in the fuel chamber rises and covers the barometric valve in the removable tank cap, at which point fuel flow from the removable tank will cease.

The barometric valve consists of a spring-loaded plunger, which has an enlarged head at one end. When the removable tank is inserted into the fuel chamber, the plunger head contacts a pin located in the fuel chamber, which pushes the plunger back, allowing the fuel in the removable tank to be in fluid communication with the fuel chamber.

When the tank is removed, the action of the spring on the plunger head forces it against the opening in the tank cap, sealing the opening and preventing fuel from leaving the tank. The capacity of the removable tank is typically about four to five liters (four to five quarts), while the fuel chamber can hold a maximum of about two liters (two quarts).

Various improvements have been made to such burners which make them safer to operate. For example, tip-over shut-off mechanisms, manual shut-off devices, and low-level $O_2$ detectors have been employed. However, these burners continue to cause fires that result in death, injury, and property loss. These fires are caused, because, under certain conditions, fuel can overflow the fuel chamber. When the overflowing fuel ignites, the result is an uncontrolled fire, or flareup.

The most common reason for fuel overflow is the inadvertent use of fuels with high vapor pressures. Examples of such fuels are gasoline, naphtha, and inferior kerosene, which has a low flash point. In a barometric heater, overflow of fuel from the fuel chamber can occur if the partial vacuum in the removable tank is lost. As the temperature of the heater and its surroundings increases, the vapor pressure of the fuel in the removable tank increases and, under certain conditions, allows fuel to escape from the removable tank at a rate greater than the pate of burning of the fuel. Should this process continue, the fuel chamber will overflow, since the removable tank holds about two to three liters more than the capacity of the fuel chamber. When the fuel chamber overflows, the fuel spills onto the top of the fuel chamber, and can then ignite, causing an uncontrolled fire. A second way that the partial vacuum in the barometric heater's removable tank can be lost is by air entering through compromise of the integrity of the removable tank.

There are safety devices that drop the wick down, thereby extinguishing the flame, if the burner tips over or experiences excessive vibration, or if abnormal combustion is detected. Other safety devices detect high levels of $CO_2$ and low levels of $O_2$ in the vicinity of the heater, and use these to control burning rates. Still others regulate the position of the wick during the ignition and extinguishing operations of the heater to prevent excessive flaming during these operations. Examples are shown in U.S. Pat. Nos. 4,363,620, issued Dec. 14, 1982 to Nakamura; 4,872,831, issued Oct. 10, 1989 to Fujimoto; 4,797,088, issued Jan. 10, 1989 to Nakamura; and 5,165,883, issued Nov. 24, 1992 to Van Bemmel. However, not only do these devices fail to prevent flareup, they are ineffective in stopping flareup after its onset. In some cases, the safety devices require the use of electrical power and electronic circuitry for actuation, and would increase the cost of the burners significantly, without rectifying the flareup problem.

It has been suggested in two publications ("Kerosene Heater Fires: Barometric Type," R. Henderson et al., *Fire Marshals Bulletin* (*National Fire Protection Association*), Vol. 87-5, p. 8 (1987); "Barometric Kerosene Heaters," R. Henderson, *Fire and Arson Investigator* (International Association of Arson Investigators), Vol. 39, No. 3, p. 26 (1989)) to make the size of the removable tank of barometric kerosene heaters comparable in volume to that of the fuel chamber so that flooding of the fuel chamber will not occur. To implement this suggestion, either the capacity of the removable tank must be reduced, or alternatively, that of the fuel chamber must be increased. However, reducing the capacity of the removable tank will reduce the burn time accordingly, and possibly affect the marketability of the heaters. Increasing the capacity of the fuel chamber will require that new tanks be designed and implemented and could increase the size of the burner to an unacceptable level.

Also, it has been suggested that a float device be introduced into the fuel chamber to be used to activate the automatic wick extinguishing mechanism, and a sight gauge be present to show dangerous fuel levels in the fuel chamber. Introduction of such a float device would also require that the fuel chamber be redesigned, as discussed above.

Although some burners have sight gauges in the fuel chamber, the sight gauges are used only to indicate whether or not fuel is present, not when dangerous fuel levels are present in the fuel chamber.

In addition it was proposed that a tank block-out device be installed. In this, a float in the fuel chamber pushes a pin that moves if the removable tank is withdrawn from the heater. Once again, such a device would require a redesigning of the fuel chamber and insertion of moving parts inside a somewhat restricted space.

U.S. Pat. No. 5,080,578, issued Jan. 14, 1992 to Josephs, claims that its device controls flareup in wick-fed liquid fuel burners by a) cutting off the flow of fuel to the wick in response to excessive heat by blocking a fuel line, and b) withdrawing the wick into the wick chamber when sensing excessive heat. However, Josephs' device has several disadvantages:

a) Excessive heat must be generated near the sensors before the flow of fuel is interrupted, or the wick is withdrawn. Therefore, since flareup is not prevented, the device only limits the spread of excessive flames after flareup has already occurred.

b) Excessive heat sensing devices must be near the area where uncontrolled burning is taking place due to overflow of fuel. Often the path that the overflowing fuel takes is random and flareup may not initially occur near the heat sensors.

c) The device is not applicable to barometric liquid fuel burners—the most common wick-fed liquid fuel burners in use—because these burners do not have fuel lines.

d) From the onset of flareup in wick-fed liquid fuel burners, fire is present outside the wick; therefore, retracting the wick does not affect the flareup process.

The device of the above-referenced related patent of Henderson and Lightsey consists, in part, of an excess fuel containment compartment below the level of the fuel chamber. It prevents flareup by activating a wick-extinguishing mechanism when the presence of excess fuel is detected in the fuel chamber. While this device has much merit, to be effective it requires activation of a second mechanism, that is, an automatic wick extinguisher. Should that mechanism fail to respond, due to tar buildup on the wick or a mechanical problem, flareup may still occur in some situations.

The device of the first above-referenced related patent of Henderson prevents flareup by lifting the removable tank when excess fuel is present in the fuel chamber, thereby shutting off the barometric valve and stopping fuel flow from the removable tank. For this device to work, it is necessary to provide a spring to lift the removable tank and its contents (liquid fuel), the total weight of which can be up to some five kilograms (ten pounds). Accordingly, should the spring lose strength, or should the removable tank become hindered in its upward movement, this device may not be able to prevent flareup in some situations.

The device of the second above-referenced related patent of Henderson prevents flareup by dropping the pin which holds open the barometric valve in the removable tank cap, thereby closing the valve and stopping fuel flow into the fuel chamber. Should the valve not close properly, or should some other mechanical malfunction occur, this device may not prevent flareup in some situations.

The device of the third above-referenced related patent application of Henderson, Ser. No. 08/365,804, prevents flareup by providing a thermal barrier between the combustion cylinder and the removable tank, which helps lower the temperature of the removable tank so that fuel vapor pressures do not become excessive. In addition, it includes a warning gauge that alerts the user to the dangerous condition of the burner when excess fuel is present in the fuel chamber. It also provides an excess fuel containment system that can hold the entire contents of the removable tank should all the fuel be released rapidly.

This system consists, in part, of a fuel containment sump, which extends upward from the top of the fuel chamber, and which surrounds the removable tank, but which does not have a closure at its top. This device has much merit in that it is effective without involving any moving parts for its operation. However, since the fuel containment sump is open at the top, fumes can escape around the tank and may be ignited by the wick flame. Also, should the removable tank be filled and inserted into the sump when excess fuel is already present in the fuel chamber, an additional charge of fuel may be introduced into the fuel containment system. The additional fuel may cause overflow of the fuel chamber, which could result in flareup.

The device of the fourth above-referenced related patent application of Henderson, Ser. No. 08/514,583, prevents flareup by containing fumes in the vicinity of the removable tank and by providing (a) a closure at the top of the compartment housing the removable tank, and (b) a block-out mechanism for the removable tank should excess fuel be present in the fuel chamber. Although this device has much merit, it requires the introduction of a tank block-out mechanism in the sump in a somewhat restricted space.

The device of the first above-referenced related patent application of Henderson and Henderson employs a thermocouple/solenoid/lever system, which lever must be engaged until the wick flame is established sufficiently such that the solenoid can maintain the position of the lever so that it does not actuate the automatic wick extinguishing mechanism. Should excess fuel enter the fuel chamber, a float causes the thermocouple/solenoid circuit to open, which releases the lever, actuating the wick extinguishing mechanism. This device has the advantage that there is a self-test of the system each time the burner is operated. On the other hand, the device requires electrical circuitry and electrical components for its operation.

OBJECTS AND ADVANTAGES

Accordingly, several objects and advantages of the present invention are to provide an improved and safer wick-fed, barometric, liquid fuel burner, to provide such a burner with a safety device which does not require the reduction in capacity of the removable fuel tank, does not require the redesigning of the fuel chamber to increase its capacity, does not require electrical power or electronic circuitry, does not require the presence of excessive heat for its actuation, is applicable to kerosene heaters that do not have fuel lines, and provides a fuel metering mechanism that monitors the fuel level in the fuel chamber and acts to restrict fuel flow into that chamber should fuel be lost from the removable tank faster than it is consumed by the wick flame.

Another object is to provide such a burner with a safety device which prevents fuel overflow from the fuel chamber, and therefore, prevents flareup.

In addition, the present burner does not have any substantially increased weight, will save lives and property, will make barometric liquid fuel burners easier to market because of added safety value, and will likely reduce the number of expensive lawsuits prompted by injury, loss of life, and property damage.

Still further objects and advantages will become apparent from a consideration of the ensuing description and drawings.

DRAWING REFERENCE NUMERALS

Figure 1:
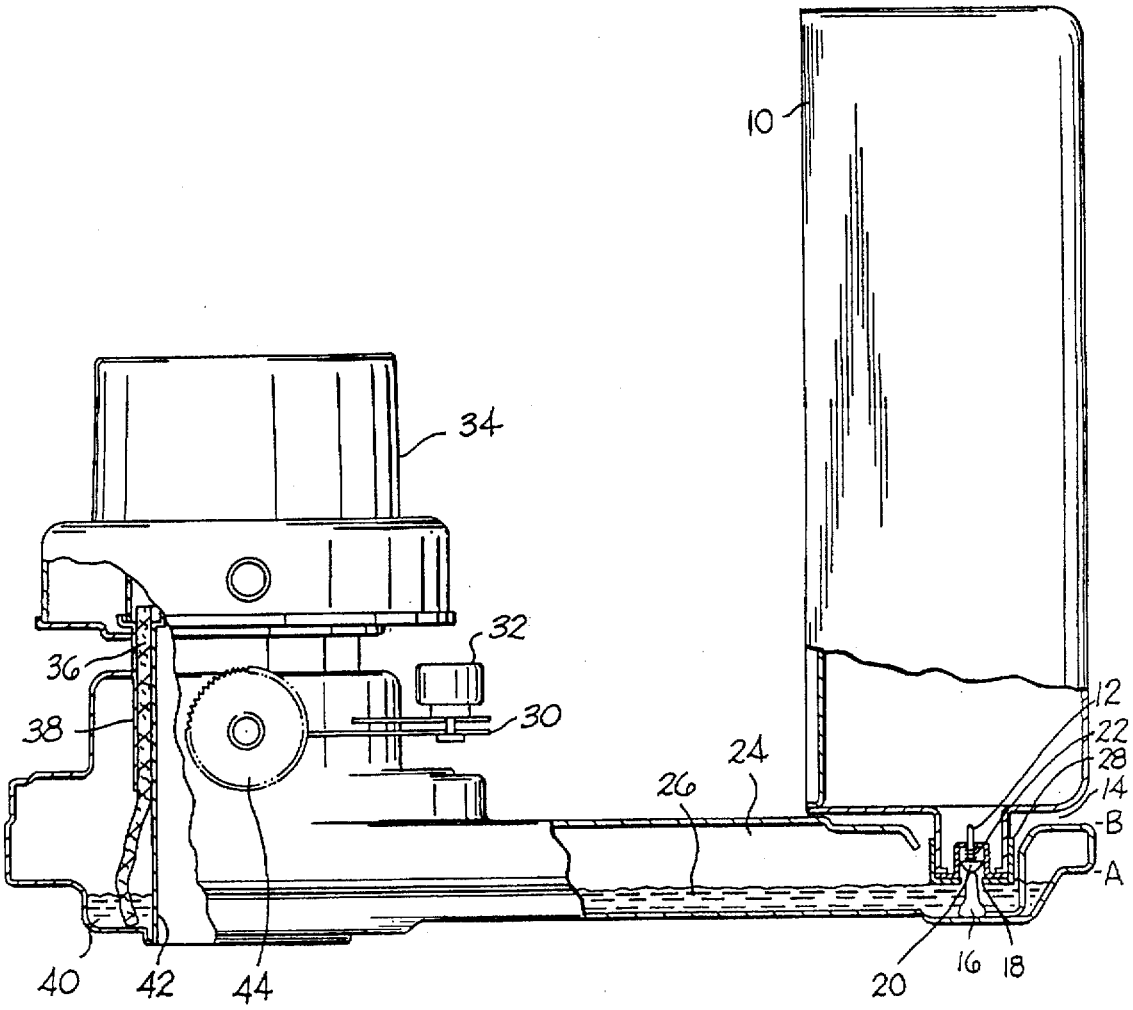
PRIOR ART FIG. 1
FIG. 1 is a side sectional view of a prior-art, wick-fed, barometric liquid fuel burner with an automatic wick extinguishing unit that can be activated by a vibration-sensing weight.

10 Removable Fuel tank
12 Plunger
14 Opening
16 Pin
18 Opening
20 Plunger head
22 Plunger spring
24 Fuel chamber
26 Fuel
28 Tank cap
30 Automatic wick extinguishing unit
32 Vibration-sensing weight
34 Combustion cylinder
36 Wick
38 Outer wick guide
40 Wick fuel supply reservoir
42 Inner wick guide
44 Wick gear
46 Opening
48 Face
50 Pivot point
52 Arm
54 Float
56 Fuel Containment Sump
58 Pivot point
60 Lid
62 Arm
64 Float
66 Sleeve
68 Warning gauge needle
70 Bottom well member
A Normal fuel level
B Flooded fuel level

SUMMARY

In accordance with the present invention, an anti-flareup safety device for wick-fed, barometric liquid fuel burners provides a fuel metering mechanism that monitors the fuel level in the fuel chamber and acts to restrict fuel flow into that chamber should fuel be lost from the removable tank faster than it is consumed by the wick flame.

Description—Conventional Heater Structure—FIG. 1

FIG. 1 is a side sectional view of a conventional barometric liquid-fuel burner (as described supra) that operates by burning a liquid fuel, such as kerosene. The burner is a wick-fed type with a combustion cylinder 34 and is constructed with basic components typical of burners widely known in the art. One manufacturer of the burner of FIG. 1 is Toyotomi of Japan, and such manufacturer sells such burners under the trademark Envirotemp by Kero-Sun.

In normal operation fuel is delivered from a removable fuel tank 10 to a horizontal fuel chamber 24 through an orifice 18 in a tank cap 28 on tank 10, in accordance with the common practice of the industry. Cap 28, which is attached to the neck of tank 10, is inserted into a mating well, or sump, in the top surface of chamber 24, also the common practice in the industry.

When the fuel level in chamber 24 drops below level A due to fuel consumption by wick 36, air will bubble into tank 10 through orifice 18 in tank cap 28, and fuel will flow from tank 10 past bottom well member 70 into chamber 24 until the level in chamber 24 rises back to level A. A partial vacuum above the fuel in tank 10 maintains the fuel in tank 10 above level A until all of the fuel has been discharged from tank 10. Fuel 26, which is in fluid communication with wick 36 via wick fuel supply reservoir 40, migrates by capillary action up the wick and is burned inside combustion cylinder 34, which generally consists of several inner metal cylinders and an outer glass cylinder. Cylinder 34 provides a surface for the burning of the fuel, and radiates heat and some light. The flame is not shown, but is seen as a red glow above the wick in cylinder 34.

Wick 36, cylindrical in shape and shown in a partial cross-sectional view, can be moved up or down between inner wick guide 42 and outer wick guide 38 by rotating a wick gear 44. Wick 36, wick guides 42 and 38, combustion cylinder 34, wick fuel supply reservoir 40, and vibration-sensing weight 32 in FIG. 1 are circular in shape when seen from above, whereas compartment 24 is generally rectangular. Removable fuel tank 10 is most commonly rectangular in shape as viewed from above, but various other shapes are also found, such as triangular. Tank cap 28 is cylindrical in shape, and is threaded to allow attachment to tank 10.

The fuel burner has an automatic wick extinguishing unit 30, which includes a vibration-sensing weight 32. If the burner is tilted or vibrated excessively, this could spill the fuel and create a fire. To prevent this, unit 30 senses the vibration, and disengages wick gear 44, which lowers wick 36, extinguishing the flame, or actuates any other wick extinguishing mechanism (not shown).

Operation and Danger of Flareup with Conventional Burner—FIG. 1

If the partial vacuum in tank 10 is lost, the barometric system described earlier no longer regulates fuel flow from tank 10. The partial vacuum may be lost by compromise of the integrity of tank 10, or by the presence of a high vapor pressure fuel in tank 10, e.g., due to heating of tank 10. Most flareup incidents occur when a high-volatility fuel is inadvertently introduced into tank 10—most commonly, gasoline or gasoline-contaminated fuel. As a result, excessive fuel will flow into chamber 24. Since the capacity of tank 10 is about two liters greater than that of chamber 24, chamber 24 will not be able to contain all of the fuel from tank 10, if any significant amount of fuel is present in tank 10. As a result, fuel fills chamber 24 and when it reaches level B, overflows via opening 14 between tank 10 and the top of chamber 24.

The fuel spreads over the fuel chamber's surface and to other areas in the burner. The flooded fuel will ignite because the vapors from the leaked fuel are drawn by air movement toward the wick flame (not shown) in cylinder 34, which is of sufficient temperature to ignite these fumes. As a result, there will be flames in and around tank 10, causing the pressure inside tank 10 to increase dramatically, driving more fuel out of tank 10, which further increases the amount of escaped fuel, and accordingly increases the severity of the flareup.

The flareup incidents involving high-volatility fuels do not occur immediately after the burners are lit, but rather after an induction period of one or more hours. There is a delay because these burners are utilized for heating purposes at cooler ambient temperatures. At such temperatures, even the high-volatility fuels have vapor pressures low enough that the partial vacuum above the liquid in the removable tank is adequate to maintain the column of fuel in the tank, which requires a pressure differential of only approximately 3 kPa (0.4 psi) for the 36 cm (14 in) height typical of removable tanks.

For example, at 21° C. (70° F.) the vapor pressure of the most volatile class of gasoline, Class E, is on the order of 69 kPa (10 psi). Since ambient pressure is around 101 kPa (14.7 psi), a column of gasoline nearly 5 m (15 ft) high could be maintained at such a pressure differential. However, should the temperature of the gasoline reach 38° C. (100° F.)—the approximate boiling point of gasoline—its vapor pressure will increase to about 101 kPa (14.7 psi), and the fuel will flow out of the removable tank and into the fuel chamber in an uncontrolled manner. This will circumvent the normal operation of the barometric valve. The increase in temperature of the air space in the removable tank during operation of the burner is not a significant factor in the loss of the partial vacuum in the removable tank. This is because the temperature increases are not rapid enough to overcome the normal action of the barometric valve in controlling fuel flow from the removable tank as fuel is consumed by the wick.

Unless the burner is in a very low temperature environment, the temperature of the removable tank will typically exceed 38° C. (100° F.) during operation of the burner. The removable tank achieves such temperatures due to its proximity, about 13 cm (5 in), to the combustion process, which reaches temperatures in excess of 850° C. (1600° F.). During operation of the burner, heat is transferred by radiation, convection, and conduction processes from the combustion cylinder to the removable tank.

The typical flareup scenario in such burners is as follows. Initially, the fuel in the removable tank is at a low enough temperature so that its vapor pressure is insufficient to allow liquid to flow from the removable tank beyond that allowed by the barometric valve. At this point, the liquid level in the fuel chamber will be maintained at the level of the barometric valve, which allows fuel to flow from the removable tank into the fuel chamber only as fuel is consumed by the wick. The temperature of the removable tank, as well as the fuel inside it, increases as thermal equilibrium is established in the burner, causing the vapor pressure of the fuel to increase. Then the increased vapor pressure of the fuel compromises the partial vacuum inside the removable tank, allowing fuel in the removable tank to flow into the fuel chamber in an uncontrolled manner. Since the capacity of the removable tank (4–5 liters) far exceeds that of the fuel chamber (1–2 liters), the fuel chamber fills and overflows. The vapors from the spilled fuel ignite and flareup ensues.

With the exception of the Henderson and Lightsey device, and the Henderson tank-lift, pin-drop, thermal barrier/fuel containment, and vapor containment/tank-block devices, prior-art safety devices do not prevent flareup, but rather detect evidence that flareup has begun, and then trigger an automatic wick extinguishing unit, which acts to extinguish the flame on the wick. However, by the time flareup has begun, there are flames outside the wick area and extinguishment of the wick flame does not affect the progression of flareup. The flames are present where fuel has flooded, and the increasing amounts of fuel being discharged from the removable tank further increase the magnitude of the flareup incident, as described earlier.

The Henderson and Lightsey device is designed to extinguish the flame on the wick prior to flareup. However, if the wick shut off mechanism fails to operate when activated as a result of the wick becoming encrusted, or if there is some other problem with the wick shut-off mechanism, this device may not be able to prevent flareup. The Henderson tank-lift and pin-drop devices are designed to shut off fuel flow from the removable tank to the fuel chamber by separating the removable tank from the pin that opens the barometric device in the cap on the removable tank cap. However, these two Henderson devices have one feature in common; should they not operate properly to stop fuel flow from the removable tank, the fuel chamber may overflow and flareup may result.

The Henderson thermal barrier/fuel containment device is a very simple and effective device; however, fuel vapors in the vicinity of the removable tank can migrate over the walls of the fuel containment sump, which surrounds the removable tank, and may be drawn to the wick flame by the air movement in the burner, where they could be ignited. Also, should excess fuel already be present in the fuel chamber, and additional fuel be introduced via the removable tank, it is possible that the fuel in the removable tank could be lost faster than the wick flame could consume it, which could result in flooding of the fuel containment system, and possibly flareup.

The Henderson vapor containment/tank block mechanism is quite simple and effective. However, in order to contain an amount of fuel equal to the full capacity of the removable tank, this device requires either a) the incorporation of two additional compartments (beyond the fuel chamber), or b) the incorporation of one additional compartment, and an increase in the capacity of the fuel chamber. The Henderson thermocouple/solenoid/lever device provides for a self-test of the system each time the burner is operated. However, it requires incorporation of electrical circuits and components, and depends on the proper functioning of the automatic wick shutoff mechanism.

Thus, prior-art safety devices, such as those which monitor excessive vibration of the burner, which detect high levels of $CO_2$ and low levels of $O_2$, which detect abnormal combustion, and which regulate the position of the wick to prevent excessive flaming, are ineffective in preventing flareup. The safety device described in the Josephs patent, supra, does not prevent flareup, but rather provides a wick-drop mechanism, and cuts off fuel flow through a fuel line after the onset of flareup. Since the wick-fed barometric liquid fuel burners in common use do not utilize a fuel line, Josephs' device is not applicable to them.

The Henderson and Lightsey, and the Henderson tank-lift and pin-drop devices are designed to prevent flareup, but should they not activate properly, flooding of the fuel chamber may occur and flareup may result. In the case of the Henderson thermal barrier/fuel containment device, vapors around the removable tank may escape and be ignited by the wick flame. Also, should the fuel containment system already contain excess fuel, flooding may occur if the removable tank is inserted with additional fuel and the loss of fuel from that tank is faster than the wick flame can consume it. To be most effective, the Henderson vapor containment/tank block device requires either the incorporation of two separate compartments as an adjunct to the fuel chamber, or an increase in the capacity of the fuel chamber and incorporation of one additional compartment. The Henderson shutoff mechanism; should that mechanism fail to respond, due to the wick becoming encrusted or if there is some other problem with the wick shutoff system, flareup may result.

Figures 2, 3:
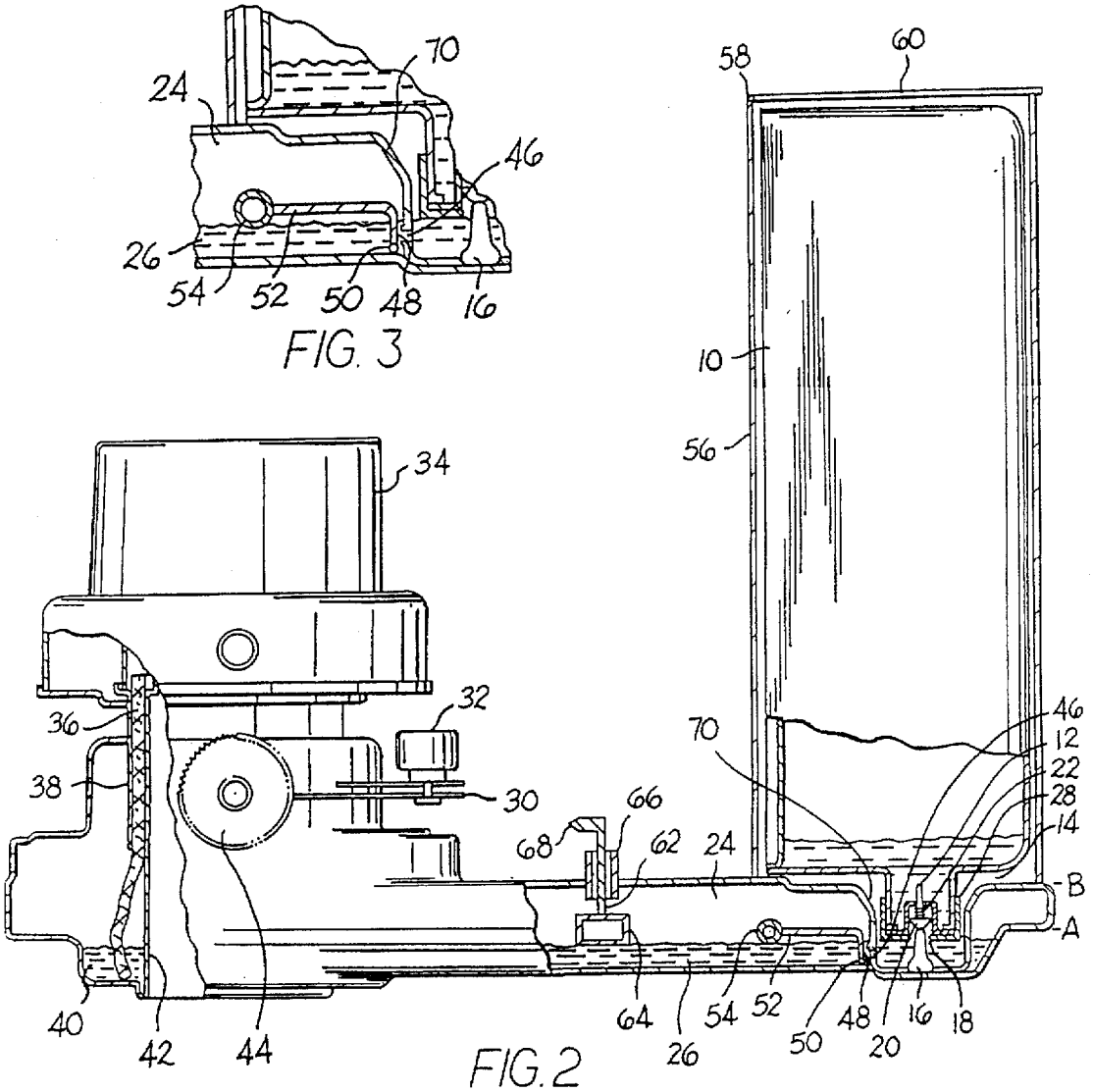
FIG. 2 is a side sectional view of a wick-fed, barometric liquid fuel burner with an anti-flareup safety device in accordance with the preferred embodiment of the present invention.

Description of Inventive Anti-Flareup Device—FIGS. 2 and 3

An improvement over the earlier anti-flareup devices is illustrated by the wick-fed barometric liquid fuel burner of FIGS. 2 and 3. It operates by providing a metering mechanism that restricts the amount of fuel entering the fuel chamber, thereby preventing flooding of the fuel chamber. It includes the following conventional elements: a removable tank 10 with a tank cap 28 which houses a spring-loaded plunger 12 functioning as a barometric valve in the usual fashion of the industry, a fuel chamber 24, a bottom well member 70, a wick 36, a wick gear 44, a combustion cylinder 34, a vibration-sensing weight 32, an automatic wick extinguishing unit 30, and certain elements of the Henderson and Lightsey device, the Henderson thermal barrier/fuel containment device, and the Henderson vapor containment/tank block device, specifically, fuel containment sump 56, lid 60, float 63, arm 62, sleeve 66, and warning gauge needle 68.

In addition, the burner of FIGS. 2 and 3 includes additional elements which constitute a preferred embodiment of the present inventive anti-flareup safety device. A float 54 is attached to an arm 52, which moves about a pivot point 50, which is secured to the bottom of compartment 24. At the right end of arm 52 (distal from float 54) is a flat face 48 that is adjacent to an opening 46 in well 70. Face 48 and opening 46 are aligned so that face 48 covers and closes off opening 46 when they are contiguous. Float 54 is preferably spherical in shape, but may be of other convenient shape, so long as it fits in the available space in chamber 24 which typically has a vertical dimension of about 2.5 cm (1 in) and a front-to-back dimension of 10 cm (4 in). Float 54 is free to move about pivot point 50 through arm 52; it has sufficient displacement, about 3 $cm^3$ (0.2 $in^3$), to cause it to move upward when fuel envelops it, and sufficient clearance from the upper surface of chamber 24 so that it can move upward freely such that the upward movement of float 54 will cause face 48 to contact well member 70 and close off opening 46 before float 54 has reached the upper surface of chamber 24. Float 54 may be cork, plastic, or other material of appropriate low density. Arm 52 is about 5 cm (2 in) long and 0.3 cm (0.01 in) in diameter, and is bent such that it positions face 48 about 3 mm (0.1 in) from opening 46 when float 54 is at its normal operating level, that is, when fuel 26 in chamber 24 is at level A. It may be composed of metal, plastic, or other convenient material. Opening 46 which is a plain hole in member 70, is approximately 1 cm (0.4 in) in diameter, and preferably circular in shape. Face 48 is about 2 cm (0.8 in) in diameter.

Operation of Inventive Anti-Flareup Device—FIG. 2

After ignition of the wick, the burner components begin to increase in temperature. The hottest location in the burner components is in the vicinity of cylinder 34, especially over it. During operation of the burner, tank 10, and the fuel inside, will become warmer, causing the vapor pressure of the fuel to increase. If a high-volatility fuel, such as gasoline, is present, the vapor pressure can become quite significant. Should there be a substantial drop in ambient pressure and/or a simultaneous appreciable temperature rise by the fuel in tank 10, the pressure differential between the inside and the outside of tank 10 may be insufficient to maintain the column of fuel inside tank 10. As a result, fuel will flow from tank 10 in an uncontrolled manner.

As fuel enters chamber 24 through opening 46, the fuel level in chamber 24 will rise, which will urge float 54 upward. As float 54 moves upward, arm 52 will concomitantly move upward about pivot point 50, which causes face 48 to move toward opening 46, thereby restricting and blocking the flow of fuel through opening 46 into chamber 24. Any excess fuel leaving tank 10 will be confined inside fuel containment sump 56, which is of sufficient capacity to hold the fuel in tank 10. Since the height of the column of fuel in the fuel containment sump will not exceed approximately 25 cm (10 in), the resulting pressure head at opening 46 will be minimal, and accordingly, float 54 can readily move face 48 to close or obturate opening 46 through its mechanical advantage via arm 52. Any fuel vapors in sump 56 will be confined inside sump 56 by lid 60.

As the wick flame burns, the fuel level in chamber 24 will drop. As a result, float 54 will move downward, thereby causing face 48 to move away from opening 46, which allows fuel to flow through opening 46 into chamber 24. In this way, when the barometric valve fails to control fuel flow from tank 10 into the sump area, the instant device will regulate the fuel flow from the sump area into the fuel chamber.

Should fuel (low- or high-volatility) be lost from the removable tank due to a compromise in the integrity of that tank, this device will operate in the manner described above, and regulate fuel flow into the fuel chamber.

Advantages

It is clear from the discussion above that the anti-flareup safety device is quite simple in construction, and can be readily incorporated in wick-fed barometric liquid fuel burners without increasing their size. Yet it will prevent flareup by providing a system that regulates fuel flow into the fuel chamber.

The present device prevents the burning of fuel outside its intended site, that being at the wick, thereby saving fuel and reducing odor. Also, the device does not require any electrical power or electronic circuitry for the prevention of flareup. The device is quite simple, requiring only one moving part, and is of small enough size that it can fit in fuel chambers in contemporary burners.

Clearly, the device will make wick-fed, barometric liquid fuel burners safer to operate, and accordingly, will at the same time reduce the expensive lawsuits resulting from flareup incidents, and will reduce the incidence of injury, loss of life, and property damage. As a result these burners will be easier to market.

RAMIFICATIONS AND SCOPE

Those skilled in the art can now appreciate from the foregoing description that the broad teachings of the present invention can be implemented in a variety of forms. Therefore, while the safety device has been described in connection with particular examples thereof, the true scope of the invention should not be so limited since other modifications will become apparent to the skilled practitioner upon a study of the drawings, specification and following claims.

For example, the shapes and composition of the various parts of the safety device can be varied greatly, so long as their function is preserved. The shape and size of float 24 may be varied, so long as it is responsive to the rise above level A in the fuel level in chamber 24, causing face 48 to be forced against opening 46, restricting further fuel flow into chamber 24. Also, the dimensions of the various components may be varied somewhat, so long as their functions are not adversely affected. Face 48 can have an obturating boss or pointed plunger, or be covered by a gasket. The penetration of member 70 to form opening 46 can be comprised of a tube extending beyond member 70.

Although the device is shown as being situated in the fuel chamber, it may be located in the sump area, or in some other convenient area, so long as its function is maintained.

Also, the device may be connected to or used in combination with other safety devices, such as warning gauges, tank block features, or shutoff mechanisms. Thus the scope of the invention should be determined, not by the examples given, but by the appended claims and their legal equivalents.

What is claimed is:

1. A method for preventing flareup in a liquid fuel burner of the type comprising a removable liquid fuel tank, a fuel chamber, a combustion chamber having a wick, and a fuel containment sump, where said sump and said fuel chamber carry liquid fuel from said removable liquid fuel tank to said wick of said combustion chamber, comprising the steps of:

(a) responding when the fuel level in said fuel chamber exceeds a predetermined level by preventing the flow of said fuel from said sump into said fuel chamber, and (c) providing a visual danger indication to alert a user when the fuel level in said fuel chamber exceeds said predetermined level so that said user will be aware that of a dangerous condition of excess fuel in said fuel chamber.

2. The method of claim 1 wherein said responding to the presence of excess fuel in said fuel chamber comprises providing a float that moves upwardly in response to the presence of excess fuel in said fuel chamber, said float being attached to an arm, said arm having a face on it.

3. The method of claim 2 wherein said preventing the flow of said fuel into said fuel chamber when the fuel level in said fuel chamber exceeds a predetermined level comprises providing a member, said member being connected to a float that rises in response to the presence of excess fuel in said fuel chamber, such that in response to the upward movement of said float, said member moves to close off fuel flow through an opening between said sump and said fuel chamber.

4. The method of claim 3, wherein said opening is circular.

5. The method of claim 2, further including means for shutting off the wick automatically should the liquid fuel burner be tilted or moved excessively.

6. The method of claim 2, wherein said responding to the presence of excess fuel in said fuel chamber comprises providing a float that moves upwardly in response to the presence of excess fuel in said fuel chamber, said float being attached to an arm, said arm having a face on it, said arm having the shape of a rod.

7. The method of claim 1, wherein said responding to the presence of excess fuel in said fuel chamber comprises providing a float that moves upwardly in response to the presence of excess fuel in said fuel chamber, said float being attached to an arm, said arm having a face on it, said face being cylindrical in shape where it abuts an opening between said sump and said fuel chamber.

* * * * *